US005915537A

United States Patent [19]

Dallas et al.

[11] Patent Number: 5,915,537

[45] Date of Patent: Jun. 29, 1999

[54] HELMET

[75] Inventors: Elizabeth Dallas, Essex Junction, Vt.; Roger M. Ball, Toronto, Canada

[73] Assignee: Red Corp., Burlington, Vt.

[21] Appl. No.: 08/780,822

[22] Filed: Jan. 9, 1997

[51] Int. Cl.[6] ..... A42B 1/06

[52] U.S. Cl. ..... 2/410; 2/425

[58] Field of Search ..... 2/410, 411, 412, 2/414, 425

[56] References Cited

U.S. PATENT DOCUMENTS

| | | | |
|---|---|---|---|
| 4,081,865 | 4/1978 | Bergee et al. . | |
| 4,397,045 | 8/1983 | Schonwetter et al. . | |
| 4,951,319 | 8/1990 | Phillips, Jr. et al. . | |
| 5,272,773 | 12/1993 | Kamata | 2/425 |
| 5,575,009 | 11/1996 | Ryvin . | |
| 5,581,819 | 12/1996 | Garneau . | |

FOREIGN PATENT DOCUMENTS

| | | |
|---|---|---|
| 0 393 238 A1 | 10/1990 | European Pat. Off. . |
| 0 474 939 A1 | 3/1992 | European Pat. Off. . |
| 0 627 180 A2 | 12/1994 | European Pat. Off. . |
| 1800716 | 8/1969 | Germany . |
| 43 11 560 A1 | 12/1993 | Germany . |
| 2-6609 | 1/1990 | Japan . |
| 3-19903 | 1/1991 | Japan . |
| 5-42241 | 2/1993 | Japan . |
| 530434 | 12/1940 | United Kingdom . |
| WO 86/04791 | 8/1986 | WIPO . |
| WO 91/12129 | 8/1991 | WIPO . |

OTHER PUBLICATIONS

English translation of Japanese Utility Model Technology Assessment for Registered No. 3050446 (Utility Model Application No. 10–000026), Mar. 30, 1998, four pages.

European Search Report for EP 97 12 2683, completed on Apr. 20, 1998, four pages.

*Primary Examiner*—Gloria M. Hale

*Attorney, Agent, or Firm*—Wolf, Greenfield & Sacks, P.C.

[57] ABSTRACT

A helmet including a selected combination or all of an outer shell, a liner and a comfort ring, the helmet being designed for use in winter sports and including climate control features to regulate the temperature, air flow and moisture within the helmet is disclosed. The helmet may include front and rear adjustable vents for selective circulation of air through the helmet to vary the temperature inside the helmet for comfort, as desired, by the user. The helmet may additionally include a comfort ring for providing abrasion resistance over exposed areas of the user, for example the ears. The comfort ring may additionally, actively contribute to controlling the interior climate of the helmet by aiding in removing and preventing moisture from contacting the skin of the user.

82 Claims, 10 Drawing Sheets

HELMET

DESCRIPTION

1. Technical Field

The present application relates to a helmet designed particularly for use in winter sports.

2. Background of Related Art

Helmets are utilized in a number of sports to help protect the user from a variety of head injuries, whether the injury is in the form of a puncture, impact, or simple abrasion. In many applications, helmets include climate control features, such as vents, in order to adjust the inner temperature of the helmet so as to provide the user with a more comfortable environment. In sports such as motorcycling, helmets generally cover a substantial portion of the head and the need for climate control features is therefore greater in such helmets. In other sports, such as cycling, the helmets are extremely lightweight and cover only the top portion of the head, complex climate control designs are, therefore, generally not required. In alpine or winter sports such as skiing and snowboarding, the helmet may be adapted to perform in an outdoor winter climate, including extreme temperature and weather conditions. Therefore, although helmets are utilized in a variety of sports and activities, the helmets are often adapted to the particular sport and/or activity for which they are intended to be utilized.

In the sport of snowboarding, conventional helmets generally include a puncture resistant outer shell encasing an impact absorbing liner. In addition, conventional helmets may also include a "comfort ring" encircling the interior portion of the helmet, along the lower edge, the comfort ring forming a soft layer of material between the skin of the wearer and the helmet liner. Conventional comfort rings include an exterior material surrounding a layer of cushioning foam which provides padding to the ring. Conventional comfort rings, therefore, do not actively contribute to helping control the interior climate of the helmet.

SUMMARY

In accordance with the present invention, there is provided a helmet including a selected combination or all of, an outer shell, a liner and a comfort ring, the helmet being designed for use in winter sports and including climate control features to regulate the temperature, air flow and moisture within the helmet. The helmet may include front and rear adjustable vents for selective circulation of air through the helmet to vary the temperature inside the helmet for comfort, as desired, by the user. The helmet may additionally include a comfort ring for providing abrasion resistance over exposed areas of the user, for example the ears. The comfort ring may additionally, actively contribute to controlling the interior climate of the helmet by aiding in removing and preventing moisture from contacting the skin of the user.

In one embodiment the vents may be located along the front and rear portions of the helmet and the helmet may include channels between the front and rear vents to provide fluid communication between the vents so as to allow air to flow over the head of the user.

In another embodiment the helmet may include channels for venting into goggles worn by the user so as to prevent and clear fogging of the goggles.

In another embodiment the comfort ring may include multiple layers of materials, an outer layer may provide abrasion resistance, another layer may provide cushioning, a third layer may provide protection against the elements such as wind and water, and an inner layer may provide for the drawing of moisture away from the skin of the user.

It is therefore an object of the present invention to provide a helmet having climate control features to regulate the temperature, air flow and moisture within the helmet.

It is another object of the invention to provide a helmet with climate control features which may be regulated by the user.

BRIEF DESCRIPTION OF THE DRAWINGS

Various embodiments are described herein with reference to the drawings, wherein.

DETAILED DESCRIPTION OF THE PREFERRED EMBODIMENTS

Figure 1:
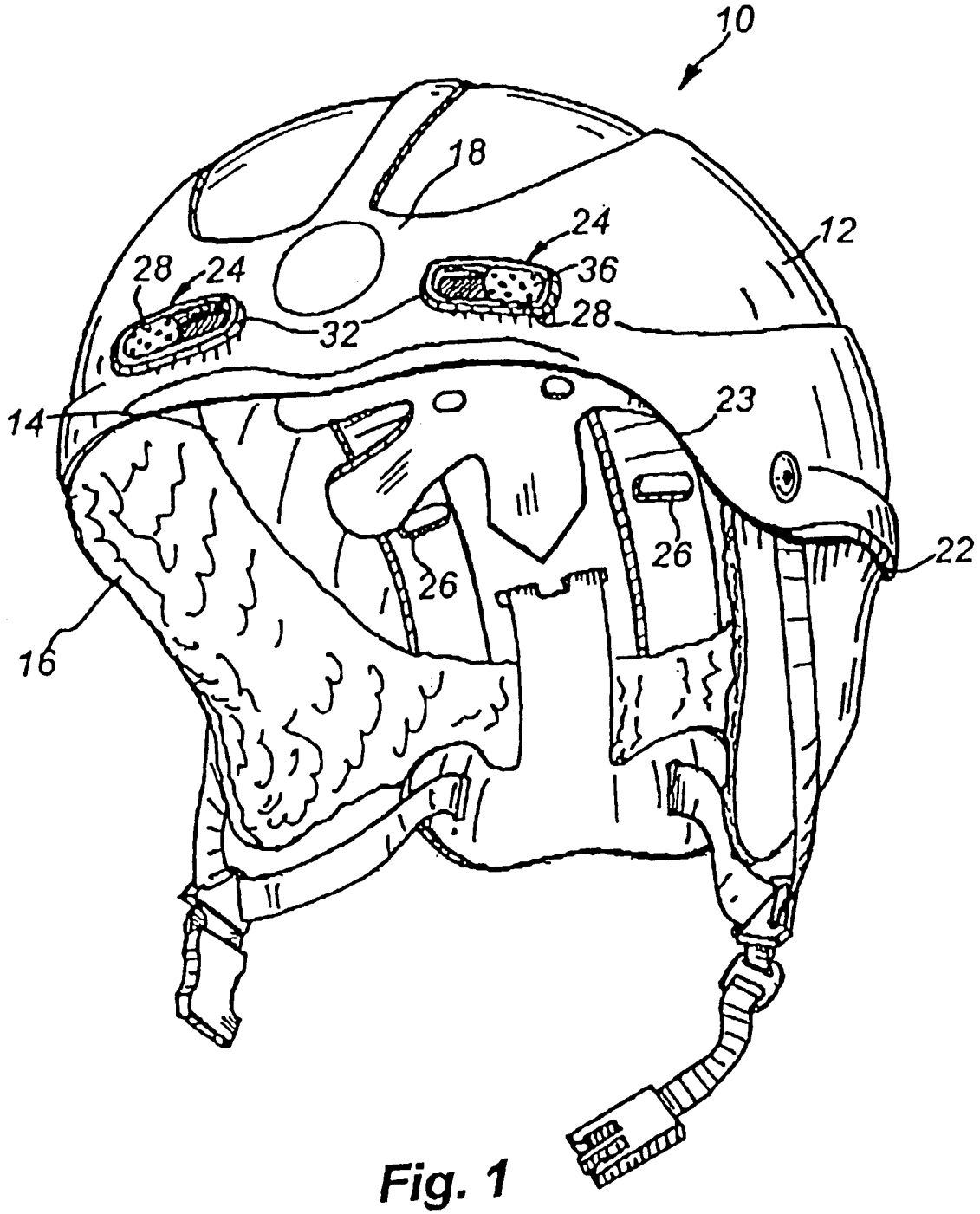
FIG. 1 is a perspective view of one embodiment of a helmet according to the present invention.

Referring initially to FIG. 1, there is illustrated a perspective view of a helmet 10, including an outer shell 12, a liner 14, and a comfort ring 16. Helmet 10 may preferably be designed for use in the sport of snowboarding, although it may have applications in other sports, for example, skiing. Helmet 10 includes a frontal portion 18, for placement over the forehead of a user, and a rear portion 20 (FIG. 4), for placement over the back of a user's head. Helmet 10 may be configured to fit snugly and comfortably over the head of a variety of users, and as such may come in a variety of sizes ranging from youth sizes through adult. Helmet 10 may be a hard-shell, impact absorbing helmet which preferably provides a user with resistance to head injury due to impact, puncture, and abrasions, when properly utilized. In the present embodiment, the helmet may be utilized in a cold weather environment, and therefore should preferably not crack or otherwise mechanically degrade in extreme temperatures or in extreme weather conditions, for example rain, sleet and snow. In addition, helmet 10 may preferably not only provide the user with protection from head injury, but may also provide the user with protection against the cold and include climate control features to preferably regulate the temperature, air flow and moisture within the helmet 10. Such climate control features may include, for example, front and rear vents 24 and 26, respectively, which may allow a user to selectively adjust airflow through the helmet, and may also include comfort ring 16 for preferably helping to prevent and remove moisture from contact with the skin of the user, as described in greater detail below.

Figure 2:
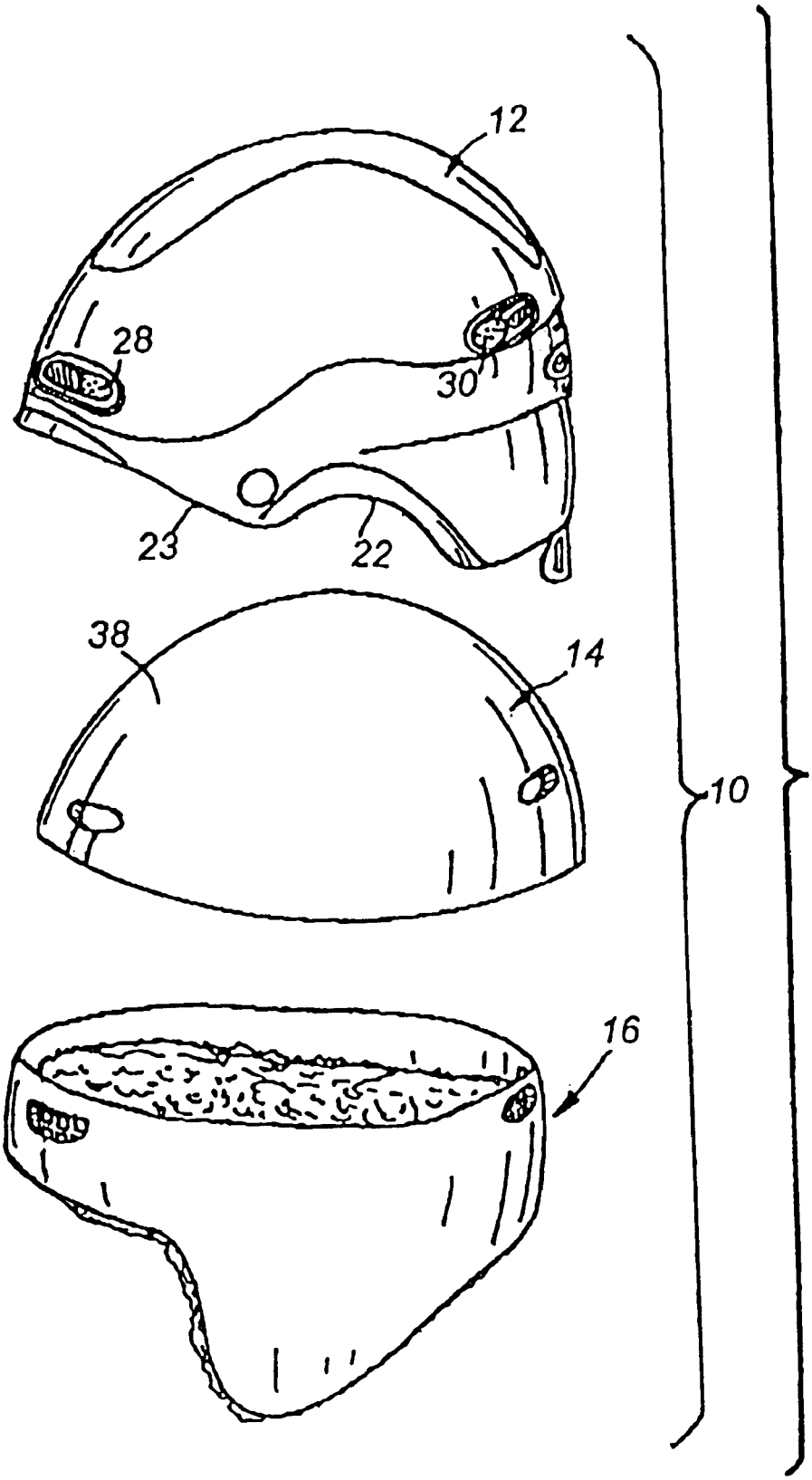
FIG. 2 is an exploded view of the helmet of FIG. 1.
Figure 4:
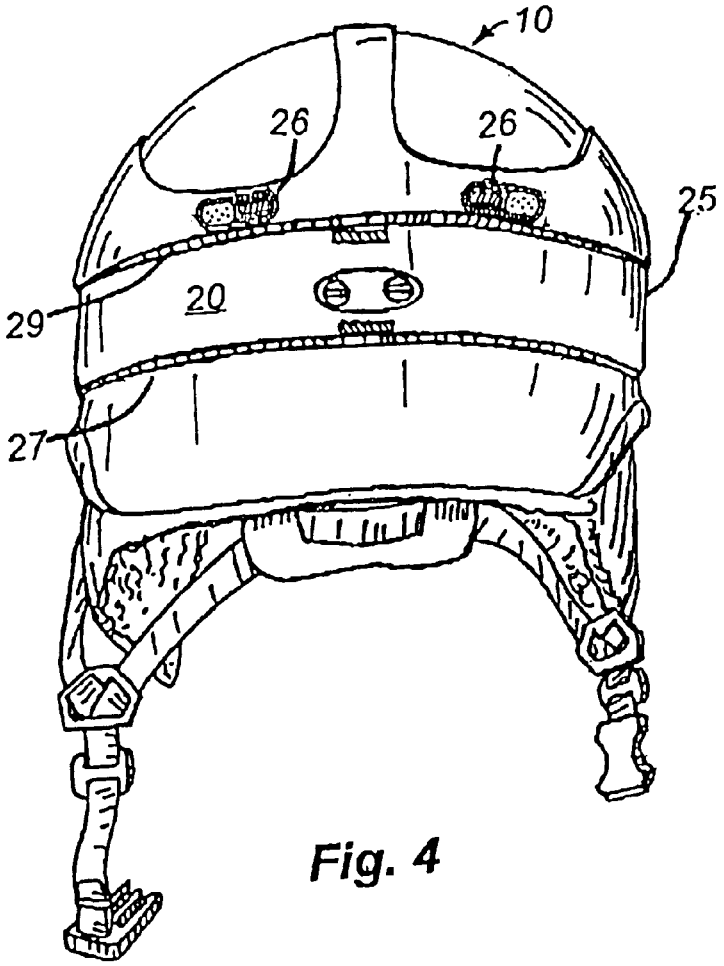
FIG. 4 is rear view of the helmet of FIG. 1.

Referring now to FIG. 1 in conjunction with FIGS. 2 and 4, outer shell 12 is designed to be puncture resistance and is preferably fabricated from a lightweight material such as nylon, ABS or a composite material, although other materials or combination of materials will be known to one of skill in the art. Outer shell 12 may preferably be contoured and include, for example, a contoured ear portion 22 to fit around the ears of the user so as to preferably not inhibit the hearing of the user. The shell may also preferably include a contoured portion 23 adjacent the sides of the user's eyes, so as not to preferably inhibit the peripheral vision of the user. Shell 12 may also include a slight lip 21 along frontal portion 18 for the channeling of melted snow and/or rain away from the front of the helmet. In addition, shell 12 may further include a stepped portion 25 disposed along the rear portion 20 of helmet 10, the stepped portion 25 being defined by a lower ridge 27 and an upper lip 29, in the present embodiment. Although an optional feature in the design of helmet 10, stepped portion 25 may help with the placement and positioning of a goggle strap 31 (FIG. 7), if utilized, over shell 12 and may also include a strap fastening device, such as clip 33 (FIG. 7) disposed thereon.

In the present embodiment, shell 12 may also include front vents 24 and rear vents 26 disposed therethrough along the frontal and rear portion of the helmet, respectively to provide circulation and flow of air through the helmet. In the present embodiment, helmet 10 includes two front vents 24 and two rear vents 26, although any number of front and/or rear vents, and combinations thereof may be utilized, as would be apparent to one of skill in the art. Front vents 24 may preferably be disposed through shell 12 above the eyes of the user, while rear vents 26 may preferably be aligned with the front vents, along the rear of shell 12. Alternately, vents 24, 26 may be disposed anywhere about the circumference of helmet 10, and may or may not be aligned, provided however, that the vents may preferably be designed to allow air to flow through the helmet, over the head of the user.

Figure 3:
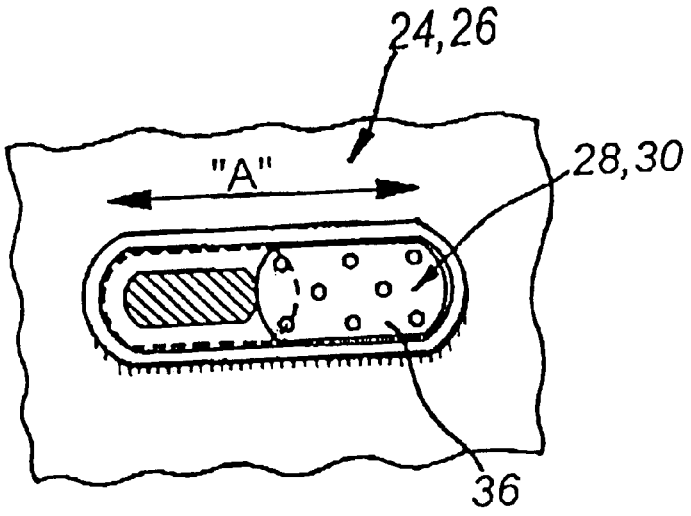
FIG. 3 is a detail view of an exemplary vent for use with the helmet of FIG. 1.

As shown in FIG. 3, vents 24 and 26 may preferably be adjustable so as to vary the airflow through helmet 10. Adjustable airflow through the helmet allows the temperature inside the helmet to be varied for comfort, depending upon the weather conditions and activity of the user. For example, the sport of snowboarding is very aerobic, and as such riders wearing a helmet may perspire and become overheated under the helmet during riding. Therefore, in such cases, airflow through the helmet may help alleviate perspiration by providing venting to help regulate the temperature inside the helmet. When riding a lift, however, the rider may prefer to stay warm and may, therefore, not wish to have air flowing through the helmet. In the present embodiment, the airflow may be readily adjusted by movement of slides 28 and 30 as indicated by arrow "A", to selectively cover vents 24 and 26. Vents 24 and 26 may be completely covered by slides 28, 30 in order to prevent airflow through the helmet, may be partially covered by slides 28, 30 in order to allow some airflow through helmet 10, or may not be covered at all by slides 28, 30 in order to allow air to flow freely through the helmet, each vent 24 and 26 being individually adjustable. Slides 28 and 30 may include a textured surface 36 to enhance gripping and movement of the slides by the user, and may preferably be friction fit within tracks 32 and 34 so that the slides retain their position until adjusted by the user. Alternate devices for selectively opening and closing vents 24 and 26 will be known to one of skill in the art, the devices preferably being easy to access and operate.

Figure 6:
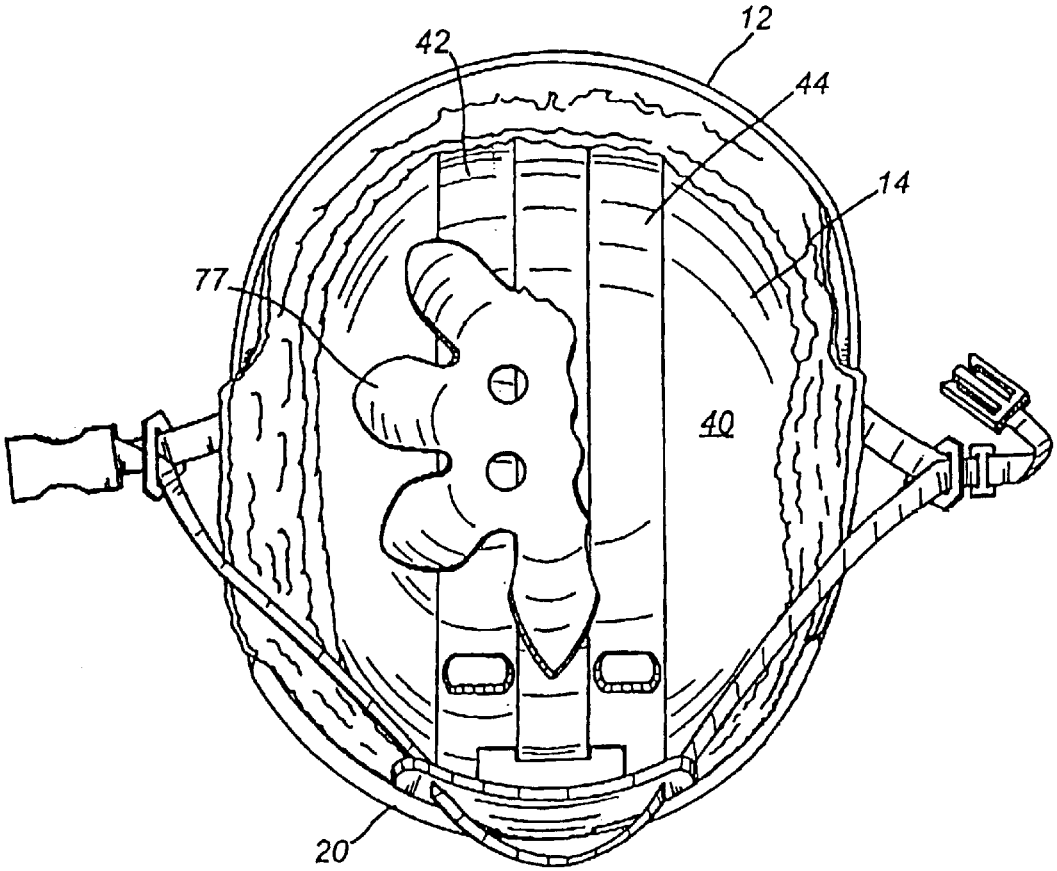
FIG. 6 is bottom view of the helmet of FIG. 1 with a foam insert partially cut-away.

Referring now to FIGS. 2 and 6, liner 14 may preferably be contoured and dimensioned to fit snugly within shell 12, the liner preferably including an outer surface 38 contacting at least a portion of shell 12 and an inner surface 40 dimensioned and configured to fit over the head of a user. Liner 14 may preferably be made of a lightweight, multiple-impact absorbing material so as to be comfortable to wear while being capable of withstanding more than one impact before requiring replacement, if replacement is required at all. In the present embodiment, liner 14 is preferably formed of an expanded polypropelene material, although other lightweight, multiple-impact absorbing materials will be known to one of skill in the art. Liner 14 may include additional thickness along the rear portion 20 of helmet 10 for added protection in case of injury to the rear of the head. Liner 14 may also include additional thickness along other portions of helmet 10, such as the sides, depending upon the intended use and corresponding protection desired.

Figure 5:
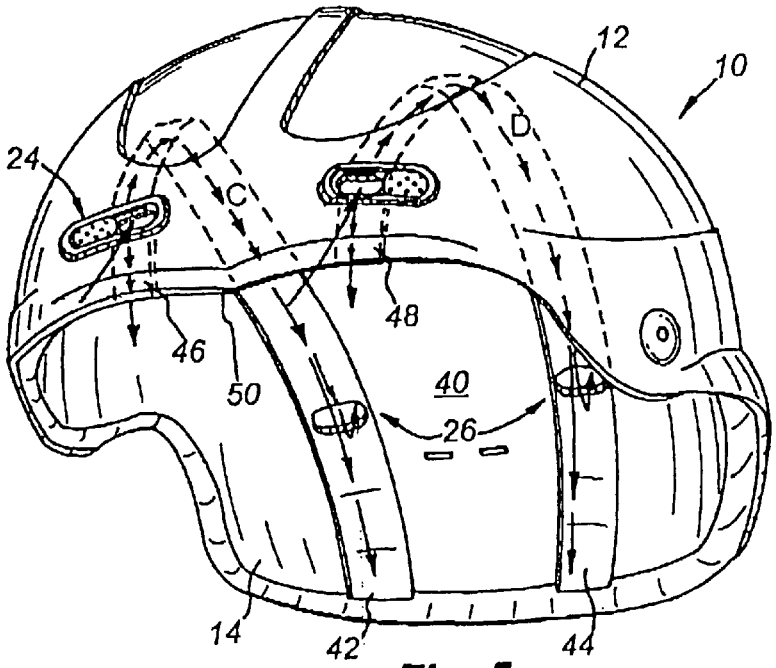
FIG. 5 is a schematic view illustrating airflow through the helmet.

As shown in FIGS. 5 and 6, liner 14 preferably includes venting channels 42 and 44 formed therein along inner surface 40 and running between front vents 24 and rear vents 26. Channels 42 and 44 may be utilized to provide fluid communication between vents 24 and 26, thereby allowing air to flow through the helmet 10 and over the head of the user, when the vents are in an at least partially open configuration, the airflow through channels 42 and 44 being illustrated by arrows "C" and "D" in FIG. 5. In the present embodiment, channels 42 and 44 may each be approximately 1 inch wide, although other dimensions are contemplated as will be apparent to one of skill in the art. Alternately, channels 42 and 44 may be formed without being recessed in liner 14, as would be known to one of skill in the art, for example the channels may be formed by inserting strips of material into the helmet, over the liner, the liner forming the base of the channels and the strips of material forming the walls.

Figure 7:
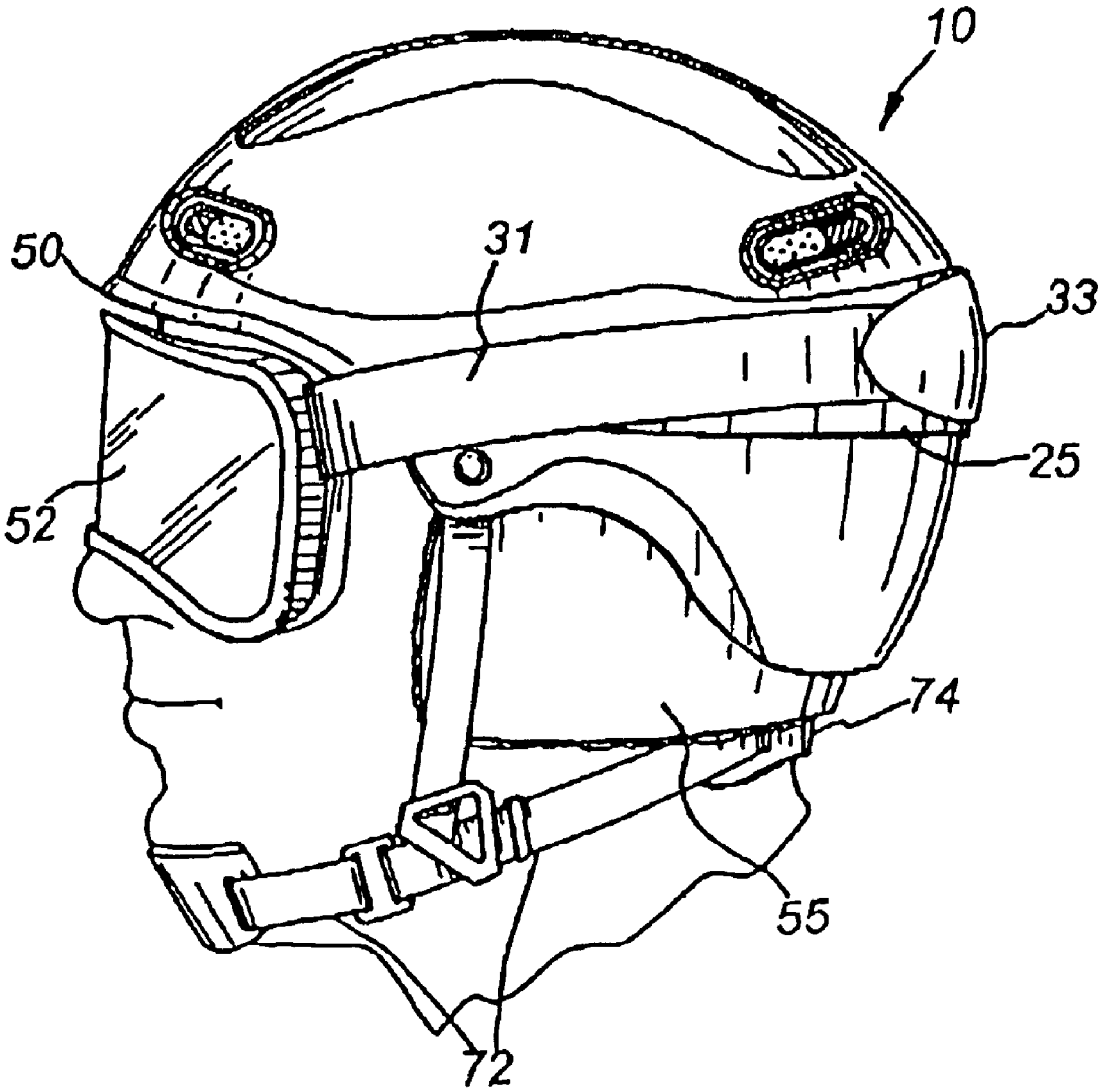
FIG. 7 is a side view of the helmet of FIG. 1 on a user.

With continued reference to FIG. 5 in conjunction with FIG. 7, liner 14 may also include a pair of front channels 46 and 48 preferably formed along outer surface 38, the front channels running between vents 24 and frontal edge 50 of helmet 10. Alternately, channels 46 and 48 may be formed within liner 14, or may be formed as part of shell 12. As shown in FIG. 7, helmet 10 may be worn with goggles 52, the goggles preferably including a foam gasket 54 and/or other venting material, as is conventional. Front channels 46 and 48 are arranged and configured so as to prevent and/or clear fogging of goggles 52 by channeling air flow entering through vents 24 out of helmet 10 and through gasket 54, when vents 24 are at least partially open. In the present embodiment, channels 46 and 48 are approximately ½ of an inch wide each, although other dimensions are contemplated as will be apparent to one of skill in the art.

Figure 8:
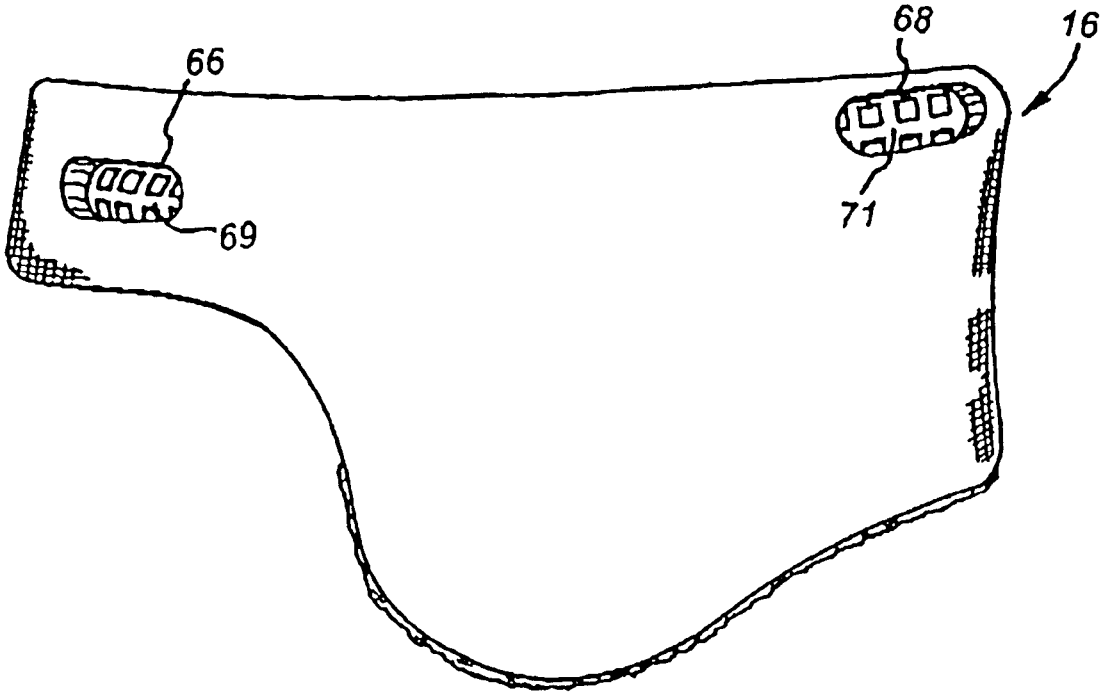
FIG. 8 is a side view of a comfort ring for use with the helmet of FIG. 1.

Referring now to FIG. 2 in conjunction with FIG. 8, there is illustrated comfort ring 16 which may be utilized in conjunction with shell 12 and liner 14. In the present embodiment, comfort ring 16 may be fabricated so as to provide helmet 10 with additional abrasion resistance from branches and the like over areas where the comfort ring covers the skin of the wearer, for example over the ears, may be fabricated so as to actively contribute to the climate control of helmet 10 and may preferably increase the comfort of helmet 10 when worn. As shown in FIG. 7, comfort ring 16 may preferably be configured and arranged to include ear flaps 55 to cover the ears and may additionally cover the back of the neck of the wearer for added comfort, warmth and protection of these areas which may otherwise be exposed. Comfort ring 16 may be continuous and be disposed within shell 12 such that a bottom portion of liner 14 is disposed within comfort ring 16. Alternately, comfort ring 16 may be non-continuous and may be secured to the outside of the liner, or be secured to the shell 12. In addition, the comfort ring may be fabricated with or without ear flaps 55, depending upon whether coverage of the ears is desired, or the comfort ring may only include ear flaps 55 secured to either the shell or liner, and not extend around the interior circumference of the helmet. In the present embodiment, comfort ring 16 may be secured to liner 14 by an adhesive material, for example tape.

Figure 9:
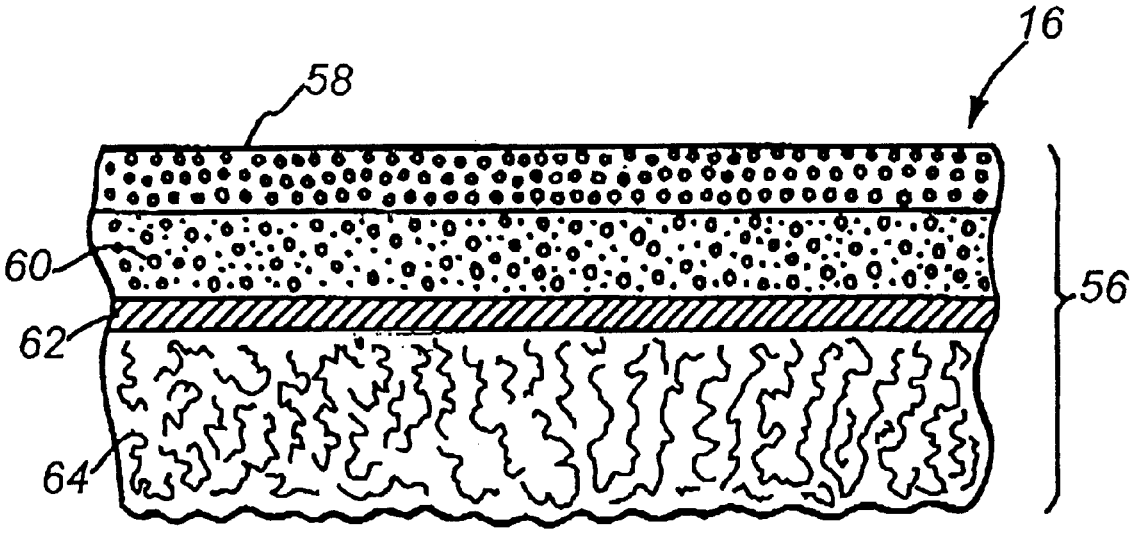
FIG. 9 is a cross-section of the comfort ring of FIG. 8.
Figure 12:
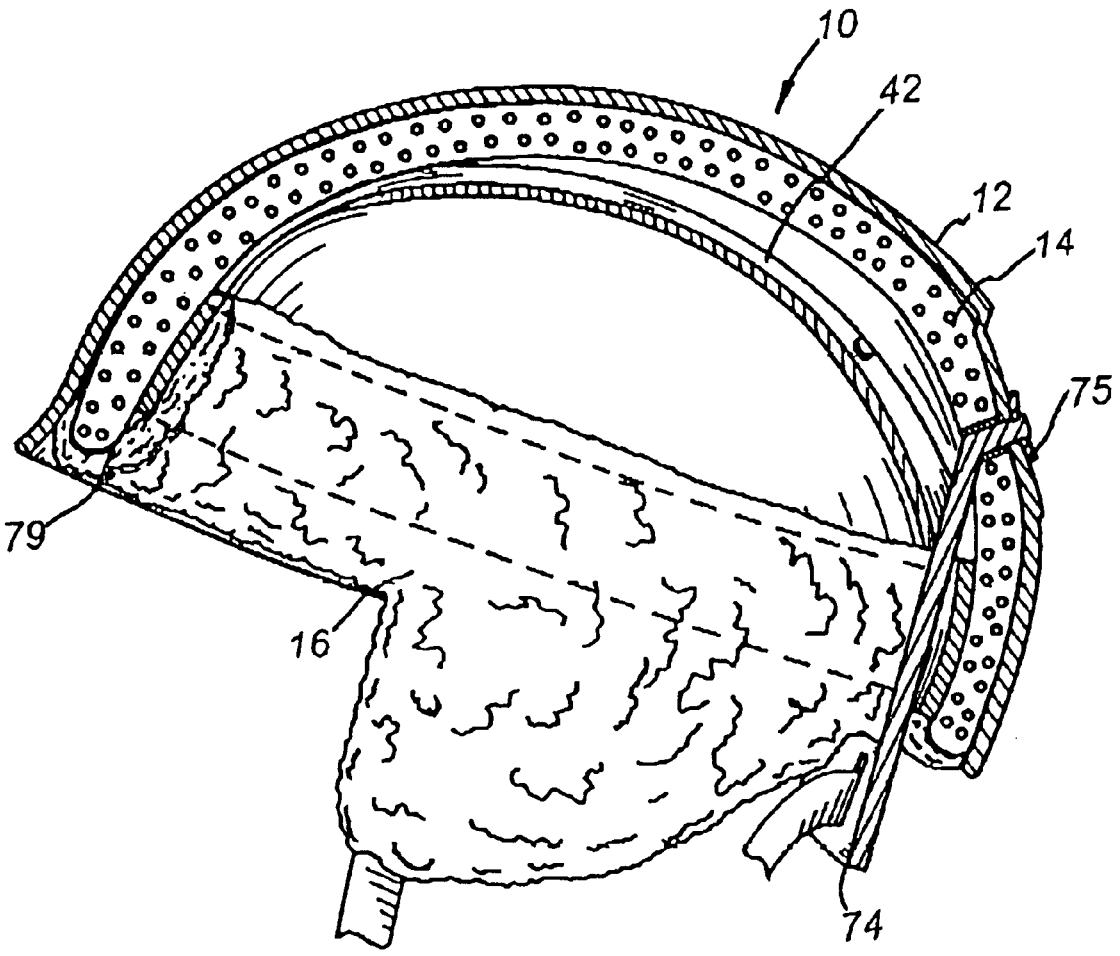
FIG. 12 is a cross-section of the helmet of FIG. 1.

Referring now to FIGS. 9 and 12, there is illustrated a cross-section of comfort ring 16, which may include multiple layers of material 56, and a cross-section of helmet 10. In the present embodiment, comfort ring 16 may include an abrasion resistant outer layer 58 for protecting a user from branches and the like, a cushioning second layer 60 for providing padding for comfort, a weather-resistant third layer 62 for providing protection against wind and moisture, and a soft liner, or inner layer 64 which may include wicking capabilities so as to draw moisture away from the skin of the wearer. Outer layer 58 may be made from any material which preferably is lightweight, flexible, abrasion resistant and adapted for a cold environment, including both temperature and weather extremes. In the present embodiment, outer layer may preferably be fabricated from a nylon Codura® material available from Dupont. Cushioning second layer 60 may be fabricated from any lightweight material, such as a low density foam, which may preferably be "breathable" and not degrade when wet. Weather resistant third layer 62 may preferably be both wind and water resistant, so that moisture which may enter through outer layer 58 and second layer 60 does not soak through third layer 62 to the skin of the user. In addition, by providing protection against the wind, third layer 62 may help protect the user from discomfort due to cold weather, and may additionally help protect against frostbite. Third layer 62 may also preferably be a uni-directional membrane so as to allow moisture to travel through the third layer in one direction, so that moisture may be drawn away from the skin of the user as described below with respect to inner layer 64. In the present embodiment, third layer may be fabricated from a material such as Tri-lite™ or Gortex® material, although other materials will be known to one of skill in the art. Inner layer 64 may preferably be fabricated from a soft, non-irritating material as the inner layer is intended to contact the skin of the user. Inner layer 64 may additionally include wicking capabilities so as to draw moisture away from the skin of the wearer as the user perspires, the moisture traveling through third layer 62 in one direction but being prevented from soaking through the third layer once drawn through. The multiple layers of material 56 may be joined together in any manner, for example by sewing or quilting the materials together. The multiple layers of material which make up comfort ring 16 interact to provide comfort and protection to the user from environmental conditions by providing abrasion resistance, padding, windproofing and by preventing and drawing moisture from contact with the user. If all of the qualities provided by the multiple layers of material 56 are not needed, or desired, any combination of the multiple layers may be utilized. For example, if abrasion resistance is not required, abrasion resistant outer layer 58 may be replaced or if weather-resistance is not required, the third layer may be eliminated, etc.

Figure 10:
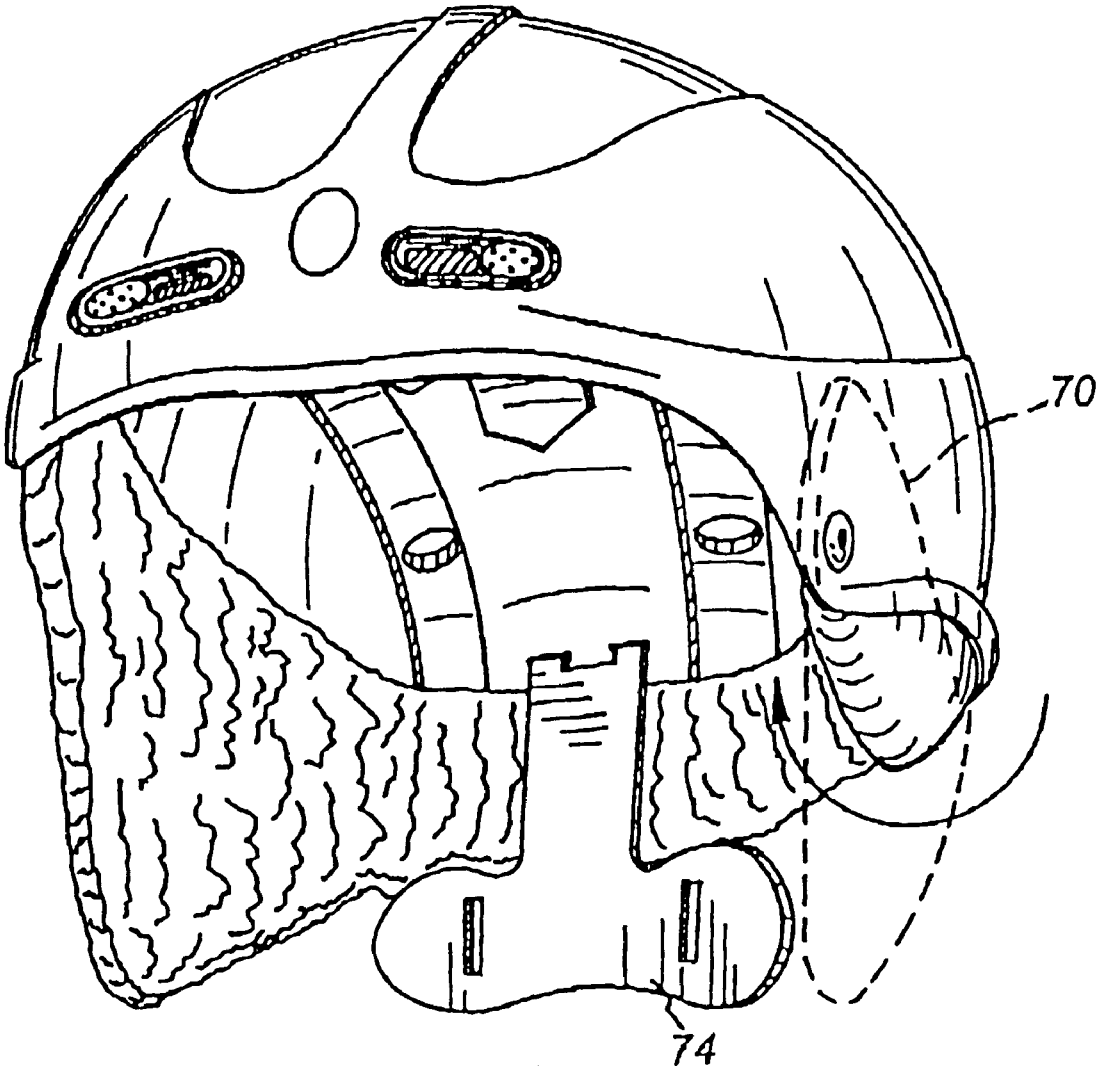
FIG. 10 is a perspective view of the helmet of FIG. 1 with an earflap raised.

Referring again to FIG. 8, comfort ring 16 may additionally include apertures 66 and 68 which are located so as to correspond with vents 24 and 26, respectively. Apertures 66 and 68 allow air to flow through helmet 10 and into channels 42, 44, 46 and 48. Comfort ring 16 may additionally include mesh 69, 71 sewn into apertures 66 and 66 which may aid in preventing snow from packing behind the vents. As shown in FIG. 10, ear flaps 55 may be configured and arranged to be tucked into a recess 70 disposed in liner 14 during warm weather, or if otherwise desired by the rider.

Figure 11:
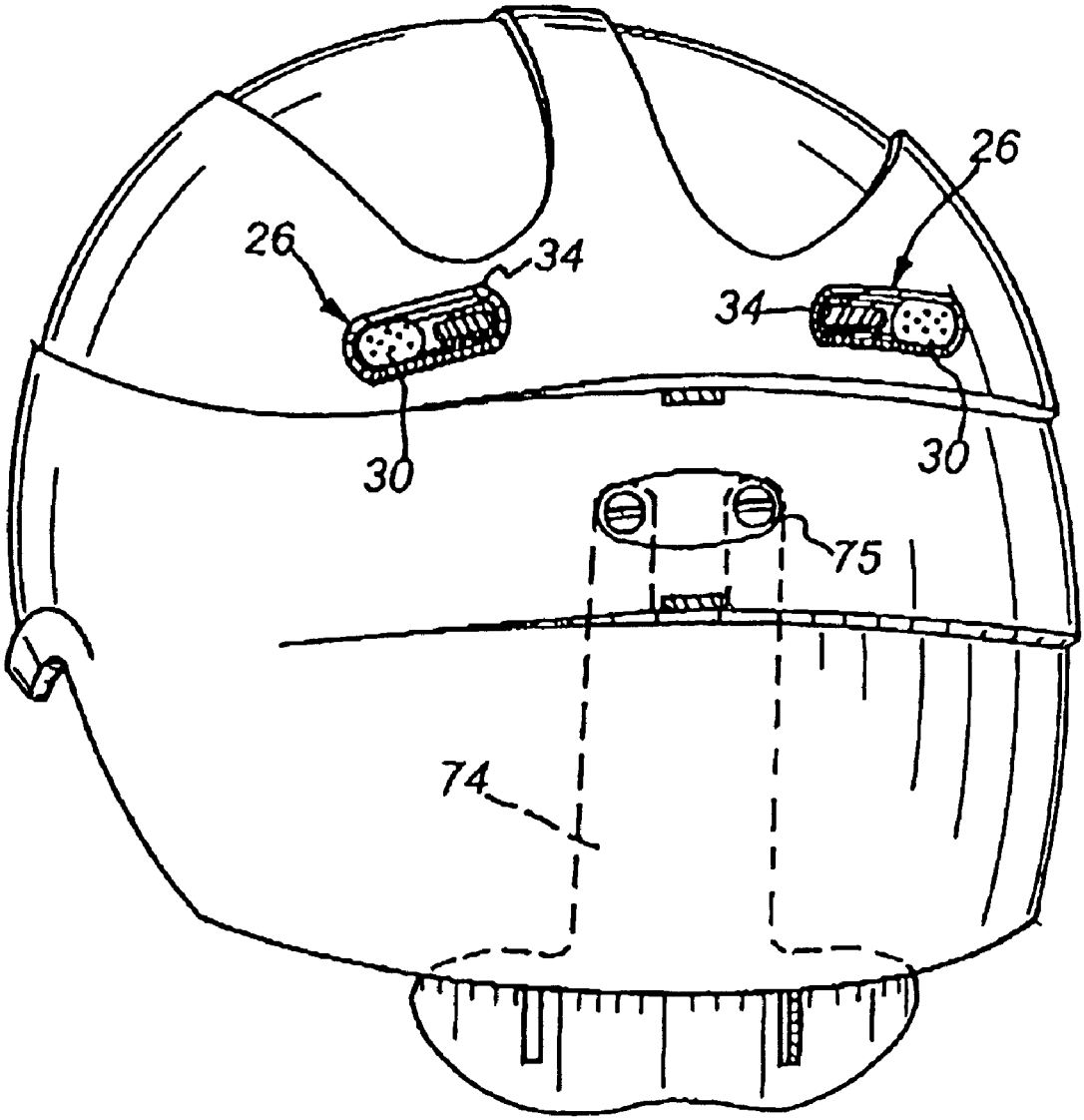
FIG. 11 is a schematic of the helmet shell and cradle.

Referring now to FIGS. 7, 10 and 11, helmet 10 may additionally include a strap 72 to secure and hold the helmet over the head of the user. The strap 72 may be releaseably secured over the chin of the user by a clip and may be a two or three point strap, a three point strap being illustrated in the embodiment of FIG. 7. As illustrated in FIG. 7, strap 72 may loop through yolk 74 along the back of helmet 10. In the present embodiment yolk 74 may be utilized to retain strap 72, and may additionally be configured and arranged to cradle the back of the user's head when helmet 10 is in position. Yolk 74 may be made of any durable, flexible material such as nylon, and may be received through liner 14 attached to helmet 10 by rivets 75, disposed through shell 12 and liner 14, thereby also helping to secure the liner within the shell, although other methods of fastening will be known to one of skill in the art. Yolk 74 may preferably cradle the occipital portion of the head to help secure helmet 10 and to provide additional comfort in the fit of the helmet on the head of the user. In addition, helmet 10 may also include a breathable fabric insert 77 attached to the inside of liner 14 and sizing strips 79 disposed between comfort ring 16 and liner 14, both insert 77 and strips 79 preferably being utilized to increase comfort and aid in fit of the helmet over the head of the user.

It will be understood that various modifications may be made to the embodiment disclosed herein. For example, the comfort ring, although shown as extending from the helmet, over the ears and rear neck of the user, may be completely disposed within the helmet. In addition, although the helmet is shown as having both vents and a comfort ring to provide climate control, the helmet may include one or both of these features. Therefore, the above description should not be construed as limiting, but merely as exemplifications of a preferred embodiment. Those skilled in the art will envision other modifications within the scope spirit of the invention.

What is claimed is:

1. A helmet for providing protection to an alpine sport user, the helmet comprising:

a hard, puncture resistant outer shell constructed and arranged for use in the sport of snowboarding; and a comfort ring supported by the helmet and constructed and arranged to overlie a portion of the user's head, the comfort ring having at least one layer for actively controlling the interior climate of the helmet, wherein the at least one layer is a wicking layer to draw moisture away from the user, the wicking layer allows moisture to travel through the wicking layer in a first direction, while preventing moisture from traveling through the wicking layer in a second direction.

2. The helmet according to claim 1, wherein the wicking layer is constructed and arranged to contact at least a portion of the user's head.

3. The helmet according to claim 1, further comprising an occipital support member constructed and arranged to cradle the occipital portion of the user's head.

4. The helmet according to claim 1, further including removable sizing strips to vary the fit of the helmet according to the user.

5. A helmet for providing protection to an alpine sport user, the helmet comprising:

a hard, puncture resistant outer shell constructed and arranged for use in the sport of snowboarding; and a comfort ring supported by the helmet and constructed and arranged to overlie a portion of the user's head, the comfort ring having at least one layer for actively controlling the interior climate of the helmet, the at least one layer being a weather-resistant layer.

6. The helmet according to claim 5, wherein the weather-resistant layer provides a barrier against wind and moisture.

7. The helmet according to claim 5, wherein the weather-resistant layer is provided between an outer layer and an inner layer of the comfort ring.

8. A helmet for providing protection to an alpine sport user, the helmet comprising:

a hard, puncture resistant outer shell constructed and arranged for use in the sport of snowboarding; and a comfort ring supported by the helmet and constructed and arranged to overlie a portion of the user's head, the comfort ring having at least one layer for actively controlling the interior climate of the helmet, the at least one layer including a wicking layer to draw moisture away from contact with the user and a weather-resistant layer to provide a barrier against wind and moisture.

9. A helmet for providing protection to an alpine sport user, the helmet comprising:

a hard, puncture resistant outer shell constructed and arranged for use in the sport of snowboarding; and a comfort ring supported by the helmet and constructed and arranged to overlie a portion of the user's head, the comfort ring having at least one layer for actively controlling the interior climate of the helmet, the comfort ring including an abrasion resistant outer surface, a portion of which extends beyond the outer shell of the helmet to protect underlying portions of the user's head from abrasions.

10. A helmet for providing protection to an alpine sport user, the helmet comprising:

a hard, puncture resistant outer shell constructed and arranged for use in the sport of snowboarding; and a comfort ring supported by the helmet and constructed and arranged to overlie a portion of the user's head, the comfort ring having at least one layer for actively controlling the interior climate of the helmet, the comfort ring including an ear portion constructed and arranged to cover the ears of the user.

11. The helmet according to claim 10, further including an inner liner constructed and arranged to fit within the outer shell of the helmet.

12. The helmet according to claim 12, wherein the inner liner includes a recess to receive the ear portion of the comfort ring so that the user can tuck the ear portion into the liner to expose the user's ears.

13. A helmet for providing protection to an alpine sport user, the helmet comprising:

a hard, puncture resistant outer shell constructed and arranged for use in the sport of snowboarding; and a comfort ring supported by the helmet and constructed and arranged to overlie a portion of the user's head, the comfort ring having at least one layer for actively controlling the interior climate of the helmet, the comfort ring being continuous.

14. The helmet according to claim 13, wherein the comfort ring extends along a back portion of the helmet adjacent the user's neck.

15. A helmet for providing protection to an alpine sport user, the helmet comprising:

a hard, puncture resistant outer shell constructed and arranged for use in the sport of snowboarding;

a comfort ring supported by the helmet and constructed and arranged to overlie a portion of the user's head, the comfort ring having at least one layer for actively controlling the interior climate of the helmet;

a first vent disposed through the helmet at a first location; and a second vent disposed through the helmet at a second location, the first and second vents being aligned so that air flows into the helmet through the first vent and out of the helmet through the second vent to regulate the temperature inside the helmet, the first and second vents each including an opening disposed through the helmet and a control element to selectively cover the opening to control the amount of airflow into and out of the helmet.

16. The helmet according to claim 15, further comprising a third vent disposed through the helmet at a third location and a fourth vent disposed through the helmet at a fourth location, wherein the third and fourth vents are aligned so that air flows into the helmet through the third vent and out of the helmet through the fourth vent to regulate the temperature inside the helmet.

17. The helmet according to claim 15, wherein the control element is a slide that is friction fit within the opening.

18. The helmet according to claim 15, wherein the first vent is disposed through a frontal portion of the helmet, adjacent the eyes of the user, and the second vent is disposed through a rear portion of the helmet and is aligned with the first vent so that air flows over the head of the user.

19. The helmet according to claim 15, further including an inner liner constructed and arranged to fit within the outer shell of the helmet, the inner liner including a first opening aligned with the first vent and a second opening aligned with the second vent to allow the to pass through inner liner.

20. The helmet according to claim 19, wherein the inner liner includes at least one channel disposed between the first vent and the second vent to direct airflow between the first and second vents.

21. The helmet according to claim 20, wherein the at least one channel is recessed in an inner surface of the liner, the inner surface being constructed and arranged to fit over the head of the user.

22. The helmet according to claim 20, wherein the at least one channel includes padding disposed between the first vent and the second vent, the padding forming the walls of the at least one channel and the inner liner disposed between the walls forming the bottom of the at least one channel.

23. A helmet for providing protection to an alpine sport user, the helmet comprising:

a hard, puncture resistant outer shell constructed and arranged for use in the sport of snowboarding;

a comfort ring supported by the helmet and constructed and arranged to overlie a portion of the user's head, the comfort ring having at least one layer for actively controlling the interior climate of the helmet;

a first vent disposed through the helmet at a first location;

a second vent disposed through the helmet at a second location, the first and second vents being aligned so that air flows into the helmet through the first vent and out of the helmet through the second vent to regulate the temperature inside the helmet; and an inner liner constructed and arranged to fit within the outer shell of the helmet, the inner liner including a first opening aligned with the first vent and a second opening aligned with the second vent to allow the air to pass through the inner liner, at least a portion of the inner liner being received within the comfort ring.

24. The helmet according to claim 23, wherein the comfort ring includes a first opening aligned with the first vent and a second opening aligned with the second vent to allow the air to pass through the comfort ring.

25. The helmet according to claim 24, wherein the comfort ring includes a mesh portion, the mesh portion covering the first opening and second opening disposed through the comfort ring, to prevent snow from packing behind the vents.

26. A helmet for providing protection to an alpine sport user, the helmet comprising:

a hard, puncture resistant outer shell constructed and arranged for use in the sport of snowboarding;

a comfort ring supported by the helmet and constructed and arranged to overlie a portion of the user's head, the comfort ring having at least one layer for actively controlling the interior climate of the helmet; and a vent disposed through the helmet at a first location, at least one opening in a frontal portion of the helmet adjacent the eyes of the user, and at least one channel constructed and arranged to direct airflow from the vent to the at least one opening so that the airflow exits the front of the helmet adjacent the eyes of the user.

27. A helmet for providing protection to an alpine sport user, the helmet comprising:

a hard, puncture resistant outer shell constructed and arranged for use in the sport of snowboarding; and a comfort ring supported by the helmet and constructed and arranged to overlie a portion of the user's head, the comfort ring having at least one layer for actively controlling the interior climate of the helmet, the outer shell including a lip constructed and arranged to channel water away from a front portion of the helmet.

28. A helmet for providing protection to an alpine sport user the helmet comprising:

a hard, puncture resistant outer shell constructed and arranged for use in the sport of snowboarding; and a comfort ring supported by the helmet and constructed and arranged to overlie a portion of the user's head, the comfort ring having at least one layer for actively controlling the interior climate of the helmet, the outer shell including a back shelf constructed and arranged to receive a goggle strap.

29. A helmet for providing protection to an alpine sport user, the helmet comprising:

a hard, puncture resistant outer shell constructed and arranged for use in the sport of snowboarding; and a comfort ring supported by the helmet and constructed and arranged to overlie a portion of the user's head, the comfort ring having at least one layer for actively controlling the interior climate of the helmet, the outer shell including a goggle clip.

30. A helmet for providing protection to an alpine sport user, the helmet including:

a hard, puncture resistant outer shell constructed and arranged for use in the sport of snowboarding; and a comfort ring supported by the helmet and constructed and arranged to overlie a portion of the user's head, a portion of the comfort ring extending beyond the outer shell and including an abrasion resistant outer surface to protect underlying portions of the user's head from abrasions.

31. The helmet according to claim 30, wherein the outer shell includes back shelf constructed and arranged to receive a goggle strap.

32. The helmet according to claim 30, wherein the outer shell includes a lip constructed and arranged to channel water away from a front portion of the helmet.

33. The helmet according to claim 30, further including a vent disposed through the helmet at a first location, at least one opening in a frontal edge of the helmet adjacent the eyes of the user, and at least one channel constructed and arranged to direct airflow from the vent to the at least one opening so that the airflow exits the front of the helmet adjacent the eyes of the user.

34. The helmet according to claim 30, wherein the portion of the comfort ring extending beyond the outer shell is constructed and arranged to cover a back portion of the user's neck.

35. The helmet according to claim 30, wherein the portion of the comfort ring extending beyond the outer shell is constructed and arranged to cover the ears of the user.

36. The helmet according to claim 35, further comprising an inner liner constructed and arranged to fit within the outer shell of the helmet.

37. The helmet according to claim 36, wherein the inner liner includes a recess to receive the ear portion of the comfort ring so that the user can tuck the ear portion of the comfort ring into the liner to expose the user's ears.

38. The helmet according to claim 30, wherein the comfort ring is continuous.

39. The helmet according to claim 30, wherein the outer shell includes a goggle clip.

40. The helmet according to claim 30, further comprising an occipital support member constructed and arranged to cradle the occipital portion of the user's head.

41. The helmet according to claim 30, further comprising a first vent disposed through the helmet at a first location and a second vent disposed through the helmet at a second location, wherein the first and second vents are aligned so that air flows into the helmet through the first vent and out of the helmet through the second vent to regulate the temperature inside the helmet.

42. The helmet according to claim 41, wherein the first vent is disposed through a frontal portion of the helmet, adjacent the eyes of the user, and the second vent is disposed through a rear portion of the helmet and is aligned with the first vent so that air flows over the head of the user.

43. The helmet according to claim 41, wherein the first and second vents each include an opening disposed through the helmet and a control element to selectively cover the opening to control the amount of airflow into and out of the helmet.

44. The helmet according to claim 43, wherein the control element is a slide that is friction fit within the opening.

45. The helmet according to claim 41, further including an inner liner constructed and arranged to fit within the outer shell of the helmet, the inner liner including a first opening aligned with the first vent and a second opening aligned with the second vent to allow the air to pass through the inner liner.

46. The helmet according to claim 45, wherein at least a portion of the inner liner is received within the comfort ring.

47. The helmet according to claim 46, wherein the comfort ring includes a first opening aligned with the first vent and a second opening aligned with the second vent to allow the air to pass through the comfort ring.

48. The helmet according to claim 47, wherein the comfort ring includes a mesh portion, the mesh portion covering the first opening and second opening disposed through the comfort ring, to prevent snow from packing behind the vents.

49. The helmet according to claim 45, wherein the inner liner includes at least one channel disposed between the first vent and the second vent to direct airflow between the first and second vents.

50. The helmet according to claim 49, wherein the at least one channel is recessed in an inner surface of the liner, the inner surface being constructed and arranged to fit over the head of the user.

51. The helmet according to claim 49, wherein the at least one channel includes padding disposed between the first vent and the second vent, the padding forming the walls of the at least one channel and the inner liner disposed between the walls forming the bottom of the at least one channel.

52. The helmet according to claim 41, further comprising a third vent disposed through the helmet at a third location and a fourth vent disposed through the helmet at a fourth location, wherein the third and fourth vents are aligned so that air flows into the helmet through the third vent and out of the helmet through the fourth vent to regulate the temperature inside the helmet.

53. A comfort ring for actively controlling the interior climate of an alpine sport helmet, comprising:

a body portion constructed and arranged in a shape to attach to the alpine sport helmet and to overlie a portion of a user's head, the body portion including:

an inner wicking layer constructed and arranged to contact a portion of the user's head so as to draw moisture away from the interior of the helmet; and a weather-resistant layer to provide a barrier to wind and moisture.

54. The comfort ring according to claim 53, further comprising an abrasion resistant outer surface constructed and arranged to extend beyond the helmet and to cover portions of the users head so as to protect underlying portions of the user's head from abrasions.

55. The comfort ring according to claim 54, further comprising a cushioning layer disposed between the abrasion resistant outer surface and the wicking layer.

56. The comfort ring according to claim 54, wherein the weather-resistant layer is disposed between the abrasion resistant outer surface and the wicking layer.

57. The comfort ring according to claim 53, wherein the wicking layer allows moisture to travel through the wicking layer in a first direction, while preventing moisture from traveling through the wicking layer in a second direction.

58. The comfort ring according to claim 53, wherein the comfort ring is continuous.

59. A helmet for providing protection to an alpine sport user, the helmet comprising:

a hard, puncture resistant outer shell contoured to fit around and not overlie the ears of the user;

an impact resistant inner liner constructed and arranged to fit within the outer shell and including an outer surface contacting at least a portion of the outer shell and an inner surface constructed and arranged fit over the head of the user, the outer shell completely covering the outer surface of the liner;

a first vent including an opening disposed through the helmet at a first location and a first control element to selectively cover the opening of the first vent and a second vent including an opening disposed through the helmet at a second location and a second control element to selectively cover the opening of the second vent, the first and second vents being aligned so that air flows into the helmet through the first vent and out of the helmet through the second vent wherein selectively covering the opening varies the airflow through the helmet to selectively regulate temperature inside the helmet.

60. The helmet according to claim 59, further comprising a strap attached to the helmet and constructed and arranged to secure the helmet to the user's head.

61. The helmet according to claim 60, further comprising an occipital support member constructed and arranged to cradle the occipital portion of the user's head.

62. The helmet according to claim 61, wherein the strap is looped through a portion of the occipital support.

63. The helmet according to claim 59, wherein the outer shell includes a goggle clip.

64. The helmet according to claim 59, wherein the outer shell includes a back shelf constructed and arranged to receive a goggle strap.

65. The helmet according to claim 59, wherein the outer shell includes a lip constructed and arranged to channel water away from a front portion of the helmet.

66. The helmet according to claim 59, wherein the first and second control elements each include a slide that is friction fit within the first and second openings.

67. The helmet according to claim 59, wherein the first vent is disposed through a frontal portion of the helmet, adjacent the eyes of the user, and the second vent is disposed through a rear portion of the helmet and is aligned with the first vent so that air flows over the head of the user.

68. The helmet according to claim 59, wherein the inner liner includes at least one channel disposed between the first vent and the second vent to direct airflow between the first and second vents.

69. The helmet according to claim 68, wherein the at least one channel is recessed in an inner surface of the liner, the inner surface being constructed and arranged to fit over the head of the user.

70. The helmet according to claim 68, wherein the at least one channel includes padding disposed between the first vent and the second vent, the padding forming the walls of the at least one channel and the inner liner disposed between the walls forming the bottom of the at least one channel.

71. The helmet according to claim 59, further comprising a comfort ring supported by the helmet, the comfort ring having at least one layer for actively controlling the interior climate of the helmet.

72. The helmet according to claim 71, wherein the at least one layer includes an inner wicking layer to draw moisture away from contact with the user and a weather-resistant layer to provide a barrier against wind and moisture.

73. The helmet according to claim 71, wherein at least a portion of the inner liner is received within the comfort ring.

74. The helmet according to claim 73, wherein the comfort ring includes a first opening aligned with the first vent and a second opening aligned with the second vent to allow the air to pass through the comfort ring.

75. The helmet according to claim 74, wherein the comfort ring includes a mesh portion, the mesh portion covering the first and second openings to prevent snow from packing behind the vents.

76. The helmet according to claim 59, further comprising a comfort ring supported by the helmet, a portion of the comfort ring extending below the inner liner and including an abrasion resistant outer layer.

77. The helmet according to claim 76, wherein the portion of the comfort ring extending below the inner liner is constructed and arranged to cover the ears of the user.

78. The helmet according to claim 59, further comprising at least one opening in a frontal edge of the helmet adjacent the eyes of the user and at least one channel constructed and arranged to direct airflow from the first vent to the at least one opening so that airflow exits the frontal portion of the helmet adjacent the eyes of the user.

79. The helmet according to claim 59, further comprising a third vent disposed through the helmet at a third location and a fourth vent disposed through the helmet at a fourth location, wherein the third and fourth vents are aligned so that air flows into the helmet through the third vent and out of the helmet through the fourth vent to regulate the temperature inside the helmet.

80. A method for defogging goggles utilized with an alpine sport helmet, comprising:

providing a first vent including an opening disposed through the alpine sport helmet at a first location for receiving air therein;

providing an opening in a frontal portion of the alpine sport helmet adjacent the eyes of the user;

directing the air from the first vent to the opening in the frontal portion so that the air exits the alpine sport helmet adjacent the eyes of the user and enters the goggles to defog the goggles.

81. A helmet for providing protection to an alpine sport user, comprising:

a hard, puncture resistant outer shell contoured to fit around and not overlie the ears of the user;

an impact resistant inner liner constructed and arranged to fit within the outer shell and including an outer surface contacting at least a portion of the outer shell and an inner surface constructed and arranged fit over the head of the user; and means for actively controlling the climate within the helmet.

82. A helmet for providing protection to an alpine sport user, comprising:

a hard, puncture resistant outer shell contoured to fit around and not overlie the ears of the user;

an impact resistant inner liner constructed and arranged to fit within the outer shell and including an outer surface contacting at least a portion of the outer shell and an inner surface constructed and arranged fit over the head of the user; and means for selectively controlling airflow through the helmet.

* * * * *